United States Patent [19]

Ricodeau

[11] Patent Number: 4,645,971

[45] Date of Patent: Feb. 24, 1987

[54] X-RAY IMAGE INTENSIFIER AND APPLICATION TO A DIGITAL RADIOLOGY SYSTEM

[75] Inventor: Jean Ricodeau, Egreve, France

[73] Assignee: Thomson-CSF, Paris, France

[21] Appl. No.: 603,244

[22] Filed: Apr. 23, 1984

[30] Foreign Application Priority Data

Apr. 29, 1983 [FR] France ..... 83 07183

[51] Int. Cl.[4] ..... H01J 31/50; H01J 40/18

[52] U.S. Cl. ..... 313/527; 313/543

[58] Field of Search ..... 313/525, 527, 530, 542–544, 313/461; 250/213 VT; 427/64, 65

[56] References Cited

U.S. PATENT DOCUMENTS

| | | | |
|---|---|---|---|
| 2,820,146 | 1/1958 | Kunes | 250/487.1 |
| 2,955,219 | 10/1960 | Niklas | 313/527 |
| 3,697,795 | 10/1972 | Braun et al. | 313/530 |
| 3,716,713 | 2/1973 | Levin | 250/213 VT |

FOREIGN PATENT DOCUMENTS

| | | | |
|---|---|---|---|
| 2340290 | 2/1974 | Fed. Rep. of Germany VT | 250/213 |
| 2144827 | 2/1973 | France | 313/573 |

*Primary Examiner*—Palmer C. DeMeo
*Assistant Examiner*—Sandra L. O'Shea
*Attorney, Agent, or Firm*—Roland Plottel

[57] ABSTRACT

The thickness of the layer of luminescent material on the edges of the screen at approximately 1/10° from the edge of the image field is approximately 15 to 25% smaller than its thickness at the center of the screen. Thus the length of the x-ray path within the luminescent material is substantially the same irrespective of the angle of incidence of the x-rays on the screen and, when the x-ray energy varies, the sensitivity at all points of the screen varies substantially in the same manner. The screen in accordance with the invention is primarily employed in digital radiology systems in which the same image is produced several times by utilizing different x-ray energies.

16 Claims, 5 Drawing Figures

X-RAY IMAGE INTENSIFIER AND APPLICATION TO A DIGITAL RADIOLOGY SYSTEM

BACKGROUND OF THE INVENTION

1. Field of the Invention

The present invention relates to an x-ray image intensifier as well as the application of said intensifier to a digital radiology system.

2. Description of the Prior Art

X-ray image intensifiers are well-known in the prior art. By way of example, relevant information on this subject will be found in an article published in volume 8, No 4 of the December 1976 issue of the Thomson-CSF technical review, under the title "Image intensification in medical and industrial radiology".

The function of an x-ray image intensifier is to convert an x-ray image to an image which can be viewed on a screen. A typical apparatus of this type comprises:

- a luminescent input screen for converting incident x-rays to light photons;
- a photocathode in optical contact with the luminescent screen for converting light photons to photoelectrons;
- an electron-optical system for focusing electron trajectories and producing a photoelectron energy gain;
- a viewing screen for the conversion of photoelectrons to light photons.

This invention is more particularly concerned with luminescent input screens for x-ray image intensifiers, hereinafter designated as X.I.I. tubes.

At the present time, these screens are usually formed by vacuum deposition, on a concave substrate, of luminescent material having a high atomic number such as cesium iodide.

In the majority of cases, known screens have either a greater thickness of luminescent material at the edges than at the center or a thickness which is substantially constant but rather greater at the edges than at the center.

FIG. 1 of the accompanying drawings is a cross-sectional view of a luminescent screen 1 having a thickness $h_b$ at the edges which is greater than the thickness $h_c$ at the center. The dashed-line curves a and b of FIG. 2 show that, in the case of known screens, the variation in thickness of the layer of luminescent material from the center to the edges expressed as a percentage of its thickness at the center of the screen is either increasing (curve a) or is substantially horizontal but exhibits a tendency to increase (curve b).

SUMMARY OF THE INVENTION

The different elements of the problem which the present Applicant proposes to solve will now be set forth.

The present Applicant desires to employ x-ray image intensifiers for systems such as the digital radiology systems in which one and the same image has to be produced several times by utilizing different x-ray energies. The different images thus obtained are digitized and processed in a computer by weighted subtraction, for example, thus finally making it possible to obtain an image in which predetermined human body organs are enhanced with respect to others.

Known types of X.I.I. tubes are ill-suited to this field of application for the following reasons.

It has been noted that, in known X.I.I. tubes, the thickness of the luminescent screen is greater at the edges than at the center. This has the effect of increasing the number of x-rays absorbed at the edges of the screen and thus correcting the low sensitivity which usually exists at the edges of the observation field. This low sensitivity is primarily due to geometrical divergence of the x-rays employed for forming the image, to cushion distortion of electron-optical systems of X.I.I. tubes, and so on.

The difference in thickness between the center and the edges of the luminescent layer of X.I.I. input screens produces a difference in x-ray absorption. When the energy of the x-rays increases, their probability of absorption decreases at a higher rate at the center than at the edges since these edges have a greater thickness than the center and the sensitivity of said edges increases with respect to the sensitivity of the center.

The present Applicant has concluded from the foregoing that known X.I.I. tubes exhibit a substantially uniform sensitivity between edges and center in respect of a given x-ray energy but that, when this energy varies, the sensitivity of X.I.I. tubes at the center of the screen and their sensitivity at the edges vary very differently. Known X.I.I. tubes are therefore not very suitable for digital radiology systems.

The present invention proposes to solve the problem presented by the conceptual design of an X.I.I. luminescent screen which can be put to effective use especially in a digital radiology system and the sensitivity of which varies in the same manner at all points of the screen when the x-ray energy varies.

As stated in claim 1, the present invention relates to an x-ray image intensifier comprising a luminescent screen for converting incident x-rays to light photons and is distinguished by the fact that the thickness of the screen is smaller at the edges of the screen than at the center.

The general object of the invention is to make the luminescent input screen identical at all points for the x-rays. In other words, it is sought to have a constant "apparent" screen thickness for all the incident x-rays. It is found necessary to reduce the thickness of the edges of the screen with respect to the center in order to ensure that the path length through the luminescent material is substantially the same for all the x-rays irrespective of their angle of incidence on the screen. Thus, when the x-ray energy varies, the sensitivity at all points of the screen varies substantially in the same manner since the path length through the luminescent material is the same for all the x-rays.

It is therefore apparent that the screen in accordance with the invention is completely different from screens of known types. It may be considered that, up to the present time, a technical prejudice had existed in favor of known luminescent screens and thus induced those versed in the art to dismiss the very concept of luminescent screens having a greater thickness at the center than at the edges. Calculation and experience, however, have clearly demonstrated the advantage of these screens in accordance with the invention.

BRIEF DESCRIPTION OF THE DRAWINGS

Other features of the invention will be more apparent upon consideration of the following description and accompanying drawings, wherein :

In the different figures, the same elements are designated by the same references but the dimensions and proportions of the various elements have not been observed for the sake of enhanced clarity.

FIG. 1 has already been described in the introductory part of this specification and the same applies to curves a and b of FIG. 2.

DESCRIPTION OF THE PREFERRED EMBODIMENTS

Figure 2:
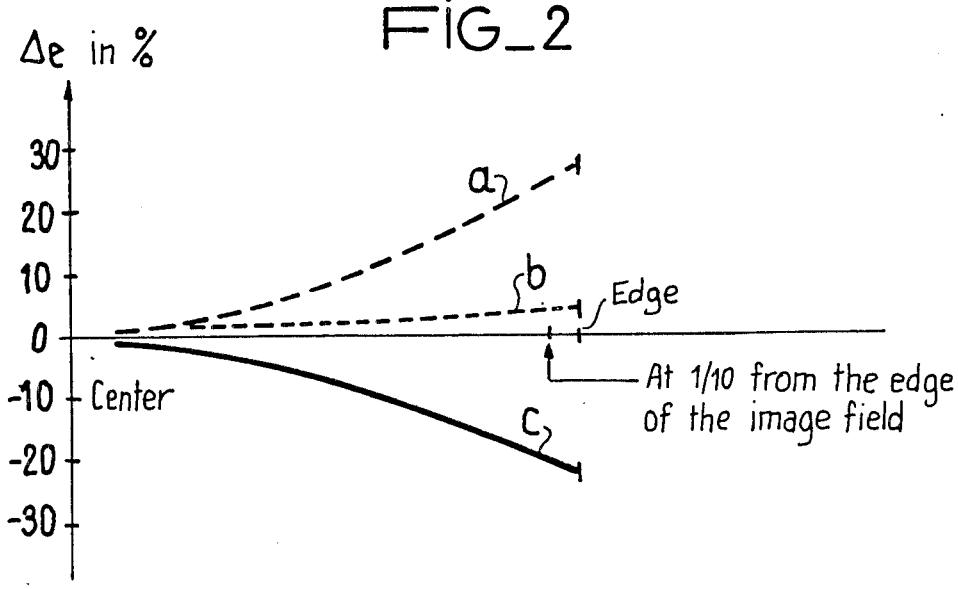
FIG. 2 are curves showing different profiles of variation in thickness of the layer of luminescent material from the center to the edges of the screen.

In FIG. 2, the full-line curve c shows the percentage variations in the value $\Delta e=(h-h_c)/h_c$ from the center towards the edges of a luminescent screen in accordance with one embodiment of the invention, where h is the thickness of the screen at any given point of this latter and $h_c$ is the thickness at the center of the screen.

Figure 1:
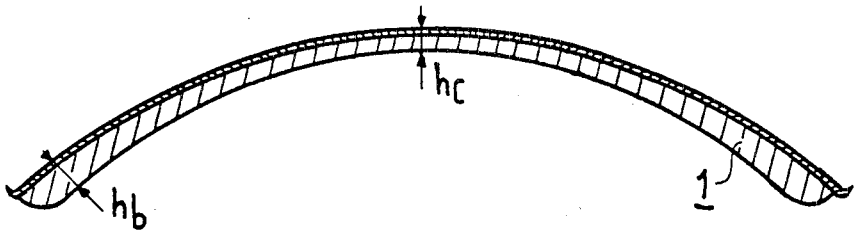
FIG 1 PRIOR ART
FIGS. 1 and 3 are sectional views showing an X.I.I. luminescent screen in accordance with the prior art, and in accordance with one embodiment of the invention respectively.

Curve c is a fall-off curve. At the edges of the image field, $\Delta e$ is substantially equal to $-20\%$. The edge of the image field is defined as follows. In the case of a screen of the type shown in FIG. 1, the projection of the screen on a surface produces a circle having a radius r. The edge of the image field is constituted by an annulus having a width of approximately r/10 or r/16 which occupies the periphery of said circle.

Figure 3:
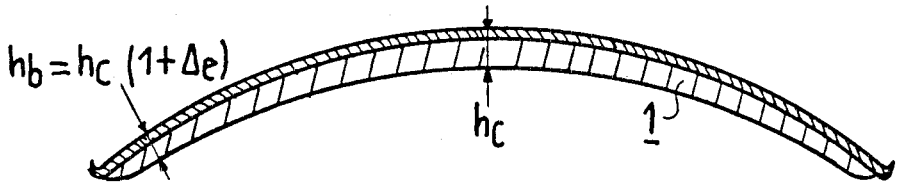

FIG. 3 is a sectional view of one embodiment of a screen in accordance with the invention and having a thickness $h_b$ at the edges which is smaller than the thickness $h_c$ at the center.

In order to ensure good performance of the electron-optical system, it is the usual practice to form luminescent screens by vacuum deposition, on a concave substrate, of a luminescent material having a high atomic number such as cesium iodide. This substrate can be either the input window of the X.I.I. tube or a component which is mounted separately within the tube.

With a view to achieving maximum absorption of x-rays, the layer of luminescent material must be of maximum thickness. This is subject, however, to the penalty of lower resolution, with the result that a compromise must be found. When vacuum-deposited cesium iodide is employed, this compromise at present corresponds to a thickness within the range of 200 to 500 micrometers.

In order to manufacture a luminescent screen of smaller thickness at the edges than at the center, it is found necessary to modify the geometrical conditions of evaporation which are usually employed for producing screens having a thickness which is greater at the edges than at the center.

The invention will now be explained with reference to FIGS. 4 and 5.

Figure 4:
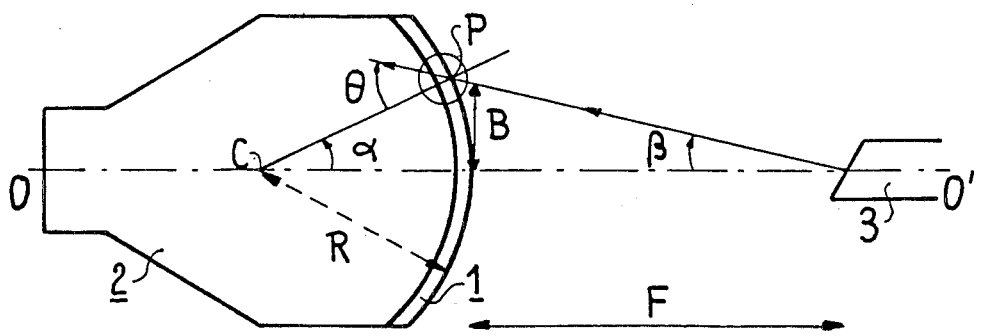
FIGS. 4 and 5 are diagrams explaining the operation of the screen in accordance with the invention.

An x-ray image intensifier 2 is shown diagrammatically in FIG. 4. The luminescent screen 1 is located on the right-hand side of the image intensifier tube. This screen receives the impact of x-rays produced by a source 3 placed on the axis O—O′ of the image intensifier at a distance F.

The luminescent screen is concave. It is postulated in the example of FIG. 4 that this screen consists of a spherical cap having a radius of curvature R. A number of alternatives, however, are open to choice for the curvature of the screen. It is thus possible to make use of concave luminescent screens, hyperbolic screens, parabolic screens, and so on. The sagitta of the screen can be given any of the different values employed in the characteristics of electron-optical systems.

Consideration is given in FIG. 4 to x-rays which are emitted by the source 3 and impinge on the screen at a point P located at a distance B from the axis O—O′.

In this figure, $\alpha$ and $\beta$ designate the angles at which the point of impact P on the screen is seen respectively from the center C of the sphere of which the screen is a spherical segment and from the x-ray source 3.

Figure 5:
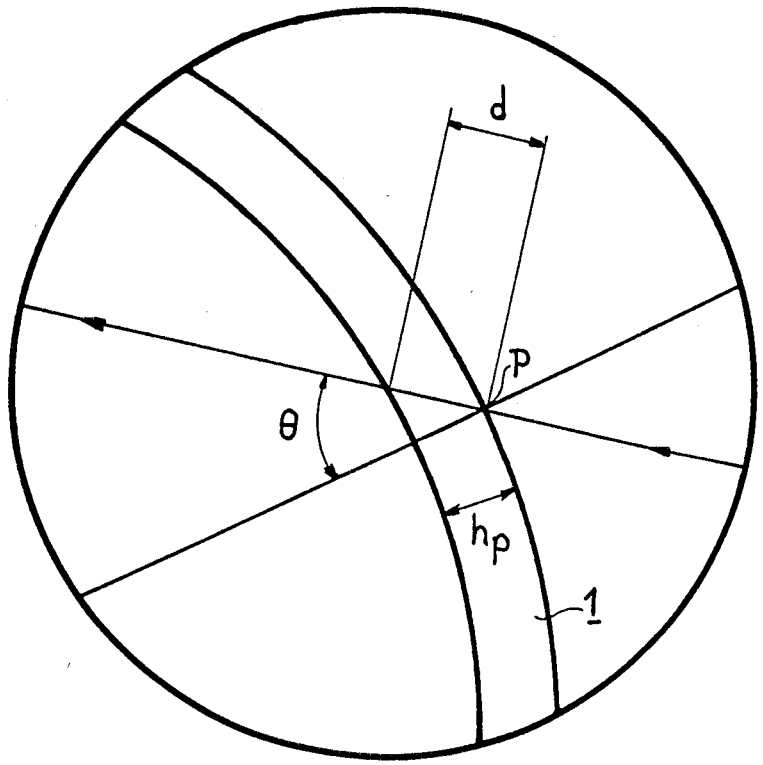

FIG. 5 is an enlarged view of the region of the screen in which the point of impact P is located.

The reference d designates the path followed within the luminescent material by the x-rays as they pass through the screen obliquely with respect to the point P.

In accordance with the invention, the path length d must be equal to the thickness $h_c$ of the screen at its center on the axis O—O′, which corresponds to the length of path followed within the luminescent material by the x-rays as they pass along the axis O—O′.

The following equality must therefore be verified :

$$d=h_c=h_p/\cos\theta,$$

where $h_p$ is the thickness of the screen at the point P and $\theta=\alpha+\beta$.

It is therefore deduced from the foregoing that the thickness $h_p$ of the screen at the point P is equal to $h_c\cdot\cos\theta$ and is therefore smaller than the thickness $h_c$ at the center of the screen.

It may accordingly be concluded that, whether the concave screen has the shape of a spherical cap or any other shape, the condition which requires that the path of the x-rays within the luminescent material of the screen should have substantially the same length irrespective of the point of impact of the x-rays on the screen can only be satisfied by ensuring that the thickness h of the screen at all points is related to its thickness $h_c$ at the center by the following relation:

$$h=h_c\cdot\cos\theta,\ \text{with}\ \theta=\alpha+\beta,$$

where $\alpha$ and $\beta$ are respectively the angles at which the points of impacts of the x-rays on the screen are seen from the center of curvature of the concave screen and from the x-ray source. These angles are expressed as follows: $\alpha=\text{Arc sin}\,(B/R)$ and $\beta=\text{Arc tg}\,(B/F)$, where B is the distance between the axis of the X.I.I. tube and the point of impact on the screen, where F is the distance between the screen and the x-ray source, and where R is the radius of curvature of the screen at the point of impact.

The following numerical values are given by way of example in the case of FIGS. 4 and 5:

$B\simeq100$ mm ; the point P defined by this distance B is located on the edges of the screen at approximately 1/10° from the edge of the image field.

$R\simeq200$ mm $F\simeq700$ mm.

The angles $\alpha$ and $\beta$ are calculated as follows: $\alpha=\text{Arc sin}\,(B/R)$ and $\beta=\text{Arc tg}\,(B/F)$, which gives $\alpha\simeq30°$, $\beta\simeq8°$ and $\theta\simeq38°$.

There is therefore obtained:

$$h_p=h_c\cdot\cos\theta=h_c\cdot\cos 38°=0.79\cdot h_c.$$

The value $\Delta e=(h-h_c)/h_c=-1+\cos\theta$ is therefore equal to $-0.21$. This means that the thickness of the luminescent layer is approximately 21% smaller at the edges, that is to say at 1/16° or 1/10° from the edge of the image field, than at the center of the screen.

It is worthy of mention that a satisfactory approach to the desired result is achieved by fabricating a screen having a thickness at the edges, namely at 1/10° or at approximately 1/16° from the edge of the image field, which is approximately 15 to 25% smaller than the thickness at the center of the screen, depending on the form of curvature of the screen and on the sagittal value. This means that the relation $h=h_c\cdot\cos\theta$ is not necessarily applied with strict accuracy at all points of the screen and that satisfactory results are obtained by applying this relation to the edges of the screen at a distance corresponding for example to approximately 1/10° or 1/16° from the edge of the image field and by applying said relation only approximately over the remainder of the screen.

The curve c of FIG. 2 can therefore have various shapes while always falling from the center to the edges. It can be noted that satisfactory results are obtained with a curve in which $\Delta e$ varies as the square of the distance to the center.

Whether it is applied to all points of the screen or only to the edges, the relation $h=h_c\cdot\cos\theta$ involves the distance F between the screen and the x-ray source. A mean value which is usually within the range of 700 to 1500 mm can be chosen for said distance F. Within this range of variation of F, the value of $\cos\theta$ depends on the value of F only to a very slight extent.

In the screens in accordance with the invention and having a smaller thickness at the edges than at the center, the sensitivity of the edges in respect of a given x-ray energy may be lower than the sensitivity at the center if no remedial measures are taken.

It is often found preferable to compensate for this lack of sensitivity of the edges by modifying the design parameters of luminescent screens in accordance with one or a number of the methods which are listed below although it will be understood that this list is not given by way of limitation:

- the dopant concentration of the luminescent material can be modified at the edges;
- the optical coupling of the photocathode with the screen can be increased at the edges or reduced at the center, for example by modifying the surface state of the luminescent layer and/or by modifying the state of the substrate on which said layer is deposited;
- the characteristics of the electrodes which form part of the electron-optical system of the x-ray image intensifier can be modified so as to reduce cushion distortion;
- the texture of the luminescent layer can be modified so as to ensure that the efficiency of conversion of x-rays to light is higher at the edges than at the center of the screen.

The screens in accordance with the invention are particularly well-suited to use in digital radiology systems which employ a computer in order to obtain an x-ray image, for example by weighted subtraction of images obtained with different x-ray energies. Use is made of x-rays having a mean energy which varies approximately between 20 to 30 KeV and 100 KeV. However, the screens in accordance with the invention are applicable to fields other than digital radiology systems and may accordingly be employed, for example, in conventional radiology systems.

What is claimed is:

1. An x-ray image intensifier tube, comprising:

a luminescent screen for converting incident x-rays to light photons, said screen being concave and projection of said screen on a surface producing a circle;

a photocathode in optical contact with the luminescent screen for converting light photons to photoelectrons;

an electron-optical system for focusing electron trajectories and producing a photo-electron energy gain;

viewing screen for the conversion of photo-electrons to light photons; wherein the thickness of the luminescent screen is smaller at the edges of the screen than at the center.

2. An x-ray image intensifier according to claim 1, wherein the thickness at the edges of the screen is approximately 15 to 25% smaller than the thickness at the center of the screen, depending on the shape of the curvature of the screen and on the value of its sagitta.

3. An x-ray image intensifier according to claim 1, wherein the screen is concave and wherein the thickness of the screen is related to its thickness at the center in accordance with the relation $h=h_c\cdot\cos\theta$, with $\theta=\alpha+\beta$, where $\alpha$ and $\beta$ are respectively the angles at which the points of impact of the x-rays on the screen are seen from the center of curvature of the screen and from the x-ray source.

4. An x-ray image intensifier according to claim 3, wherein the relation $h=h_c\cdot\cos\theta$ is applied to all points of the screen.

5. An x-ray image intensifier according to claim 3, wherein the relation $h=h_c\cdot\cos\theta$ is applied essentially to the edges of the screen.

6. An x-ray image intensifier according to claim 3, wherein the relation $h=h_c\cdot\cos\theta$ is calculated by taking a mean value within the range of variation of the distance between the screen and the x-ray source.

7. An x-ray image intensifier according to claim 1, wherein the lack of sensitivity of the edges of the screen is compensated by modifying one or a number of the following parameters of luminescent screens:

the dopant concentration of the luminescent material;

the optical coupling of the photocathode of the image intensifier with the screen, by modifying the state of surface of the luminescent layer and/or the state of the substrate on which said layer is deposited;

the characteristics of the electrodes which form part of the electron-optical system of the image intensifier in order to reduce cushion distortion.

8. An x-ray image intensifier according to claim 2, wherein the screen is concave and wherein the thickness of the screen is related to its thickness at the center in accordance with the relation $h=h_c\cdot\cos\theta$, with $\theta=\alpha+\beta$, where $\alpha$ and $\beta$ are respectively the angles at which the points of impact of the x-rays on the screen are seen from the center of curvature of the screen and from the x-ray source.

9. An x-ray image intensifier according to claim 8, wherein the relation $h=h_c\cdot\cos\theta$ is applied to all points of the screen.

10. An x-ray image intensifier according to claim 8, wherein the relation $h=h_c\cdot\cos\theta$ is applied essentially to the edges of the screen.

11. An x-ray image intensifier according to claim 4, wherein the relation $h=h_c \cdot \cos\theta$ is calculated by taking a mean value within the range of variation of the distance between the screen and the x-ray source.

12. An x-ray image intensifier according to claim 5, wherein the relation $h=h_c \cdot \cos\theta$ is calculated by taking a mean value within the range of variation of the distance between the screen and the x-ray source.

13. An x-ray image intensifier according to claim 8, wherein the relation $h=h_c \cdot \cos\theta$ is calculated by taking a mean value within the range of variation of the distance between the screen and the x-ray source.

14. An x-ray image intensifier according to claim 9, wherein the relation $h=h_c \cdot \cos\theta$ is calculated by taking a mean value within the range of variation of the distance between the screen and the x-ray source.

15. A digital radiology system which includes an x-ray image intensifier tube in accordance with claim 1, and x-ray source of variable energies of x-rays, means for irradiating an object to be analyzed a plurality of times such with a different energy of x-rays from said source for deriving a plurality of images of the object, and means for processing the plurality of images for obtaining a single image in which desired features of the object are enhanced.

16. An x-ray image intensifier according to claim 10, wherein the relation $h=h_c \cdot \cos\theta$ is calculated by taking a mean value within the range of variation of the distance between the screen and the x-ray source.

* * * * *